US008066366B2

(12) United States Patent
Fioravanti et al.

(10) Patent No.: US 8,066,366 B2
(45) Date of Patent: Nov. 29, 2011

(54) RELEASE AGENT APPLICATOR FOR IMAGING MEMBERS IN SOLID INK JET IMAGING SYSTEMS

(75) Inventors: Alexander J. Fioravanti, Penfield, NY (US); Paul J. McConville, Webster, NY (US); James J. Padula, Webster, NY (US); Michael Jon Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 402 days.

(21) Appl. No.: 12/435,005

(22) Filed: May 4, 2009

(65) Prior Publication Data

US 2009/0211521 A1 Aug. 27, 2009

(51) Int. Cl.
*B41J 2/01* (2006.01)

(52) U.S. Cl. ..... 347/103; 347/85; 399/174; 399/325; 118/60; 118/244; 118/264; 118/270; 424/451; 604/307

(58) Field of Classification Search ..... 347/103
See application file for complete search history.

(56) References Cited

U.S. PATENT DOCUMENTS

| | | | | |
|---|---|---|---|---|
| 3,964,431 | A | 6/1976 | Namiki | |
| 5,534,986 | A * | 7/1996 | Irro et al. | 399/325 |
| 5,779,795 | A | 7/1998 | Bucher et al. | |
| 5,788,770 | A | 8/1998 | Hobson et al. | |
| 6,212,355 | B1 | 4/2001 | Bunn et al. | |
| 6,336,972 | B1 * | 1/2002 | Kimura et al. | 118/270 |
| 6,434,357 | B1 | 8/2002 | Maul et al. | |
| 6,579,813 | B1 | 6/2003 | Kimura et al. | |
| 6,666,939 | B2 * | 12/2003 | Kimura et al. | 156/93 |
| 2003/0064095 | A1 | 4/2003 | Martin et al. | |
| 2005/0085360 | A1 | 4/2005 | Lebold et al. | |

* cited by examiner

*Primary Examiner* — Matthew Luu
*Assistant Examiner* — Renee Wilson
(74) *Attorney, Agent, or Firm* — Maginot, Moore, & Beck LLP

(57) ABSTRACT

A release agent applicator applies release agent to an imaging drum and absorbs release agent metered from the drum to extend the operational life of an image drum maintenance unit. The applicator includes a reservoir for storing release agent, the reservoir having a plurality of perforations for enabling release agent to seep from the reservoir, a containment membrane for wicking release agent from the perforations of the reservoir, and a delivery layer for delivering release agent from the containment membrane to an imaging drum, the delivery layer having pores in a range of about 50 μm to about 200 μm.

17 Claims, 6 Drawing Sheets

RELEASE AGENT APPLICATOR FOR IMAGING MEMBERS IN SOLID INK JET IMAGING SYSTEMS

PRIORITY CLAIM

This application claims priority through U.S. patent application Ser. No. 11/347,972, which is entitled Improved Release Agent Applicator For Imaging Members In Solid Ink Jet Imaging Systems and was filed on Feb. 6, 2006. This application issued as U.S. Pat. No. 7,540,600 on Jun. 2, 2009.

TECHNICAL FIELD

This disclosure relates generally to solid ink jet imaging systems, and, more particularly to such systems that use an intermediate member onto which an image is generated before being transferred to a media sheet.

BACKGROUND

In solid ink imaging systems having intermediate members, ink is loaded into the system in a solid form, either as pellets or as ink sticks, and transported through a feed chute by a feed mechanism for delivery to a heater assembly. A heater plate in the heater assembly melts the solid ink impinging on the plate into a liquid that is delivered to a print head for jetting onto an intermediate member. In the print head, the liquid ink is typically maintained at a temperature that enables the ink to be ejected by the printing elements in the print head, but that preserves sufficient tackiness for the ink to adhere to the intermediate member. In some cases, however, the tackiness of the liquid ink may cause a portion of the ink to remain on the intermediate member after the image is transferred onto the media sheet. This remnant of the jetted image may later degrade other images formed on the intermediate member.

Solid ink jet imaging systems generally use an electronic form of an image to distribute ink melted from a solid ink stick or pellet in a manner that reproduces the electronic image. In some solid ink jet imaging systems, the electronic image may be used to control the ejection of ink directly onto a media sheet. In other solid ink jet imaging systems, the electronic image is used to eject ink onto an intermediate imaging member. A media sheet is then brought into contact with the intermediate imaging member in a nip formed between the intermediate member and a transfer roller. The heat and pressure in the nip helps transfer the ink image from the intermediate imaging member to the media sheet.

One issue arising from the transfer of an ink image from an intermediate imaging member to a media sheet is the transfer of some ink to other machine components. For example, ink may be transferred from the intermediate imaging member to a transfer roller when a media sheet is not correctly registered with the image being transferred to the media sheet. The pressure and heat in the nip may cause a portion of the ink to adhere to the transfer roller, at least temporarily. The ink on the transfer roller may eventually adhere to the back side of a subsequent media sheet. If duplex printing operations are being performed, the quality of the image on the back side is degraded by the ink that is an artifact from a previous processed image.

To address the accumulation of ink on a transfer roller, various release agent applicators have been designed. These release agent applicators provide a coating of a release agent, such as silicone oil, onto the transfer roller. The release agent coating helps reduce the likelihood of ink adhering to the transfer roller. The release agent applicator needs to be in fluid communication with a supply of release agent and the structure of the applicator needs to transport an effective amount of the release agent from the release agent supply to the transfer roller. An effective amount of release agent resists accumulation of ink on the transfer roller without providing excess release agent that is transferred to a media sheet. The transfer of release agent to a media sheet may also degrade image quality.

U.S. Pat. No. 6,434,357 describes various oil delivery systems for providing release agent to a transfer roller and some of the limitations encountered with these systems. In an effort to address some of these limitations, release agent rollers have been developed that use multiple layered materials about a roller to meter release agent to a transfer roller. For example, U.S. Pat. No. 6,212,355 describes a release agent roller that has an oil supply reservoir located along the central axis of the cylinder formed by the roller. The reservoir is perforated with pores that enable the oil to seep out of the reservoir. An oil distribution layer is wrapped around the reservoir to transport the oil seeping from the reservoir in an evenly distributed manner. An outer liquid permeation control layer encloses the oil distribution layer to regulate the release of the oil to the transfer roller. As explained above, regulation of the amount of the release agent is important to prevent excess oil from being applied to the transfer roller, and subsequently, to the media sheets.

In solid ink imaging systems having intermediate members, release agent is applied to the intermediate imaging member to reduce build-up of ink on the intermediate member. Release agent applicators for intermediate imaging members are required to provide release agent to the intermediate members at levels different than release agent applicators for transfer rollers. Specifically, release agent applicators for transfer rollers need to limit the amount of oil applied to the transfer roller because a portion of a transfer roller does come in contact with the media sheet passing through the transfer nip. Typically, release agent applied to a media sheet is 5 mg/sheet or less. In order to reduce the likelihood of liquid ink adhering to the intermediate imaging member, release agent is typically applied to an intermediate member at levels greater than 10 mg/sheet.

Application of release agent to an intermediate imaging member in the amounts noted above may be achieved with a sump system in which a roller is partially immersed in an oil sump. As the release agent roller of an image drum maintenance system rotates out of the sump, it applies release agent to the intermediate imaging member in an amount that is 10 mg/sheet or greater. Prior to the intermediate imaging member reaching the transfer roller nip, the release agent may be metered with a metering blade so the amount of oil on the intermediate member does not degrade the media sheet in the nip. The excess oil metered from the intermediate member is directed back into the sump.

While a release agent sump system provides release agent to the intermediate imaging member in an effective amount, it suffers from some limitations. One limitation arises from the use of a porous layer to apply release agent to the imaging member. The release agent is supplied to the porous layer from pores of a release agent reservoir. The porous layer absorbs enough release agent from the reservoir that it becomes saturated. This saturation prevents the porous layer from effectively picking up release agent that has been returned to the sump. Consequently, the release agent is lost as it languishes in the sump. Release agent continues to be supplied from the release agent reservoir, even though release agent is present in the sump, until the release agent reservoir is exhausted. Thus, the operational life of the image drum maintenance system is extinguished despite the presence of unused release agent.

SUMMARY

A release agent applicator applies release agent to an imaging drum and absorbs release agent metered from the drum to extend the operational life of an image drum maintenance unit. The applicator includes a reservoir for storing release agent, the reservoir having a plurality of perforations for enabling release agent to seep from the reservoir, a containment membrane for wicking release agent from the perforations of the reservoir, and a delivery layer for delivering release agent from the containment membrane to an imaging drum, the delivery layer having pores in a range of about 50 μm to about 200 μm.

DETAILED DESCRIPTION

Figure 1:
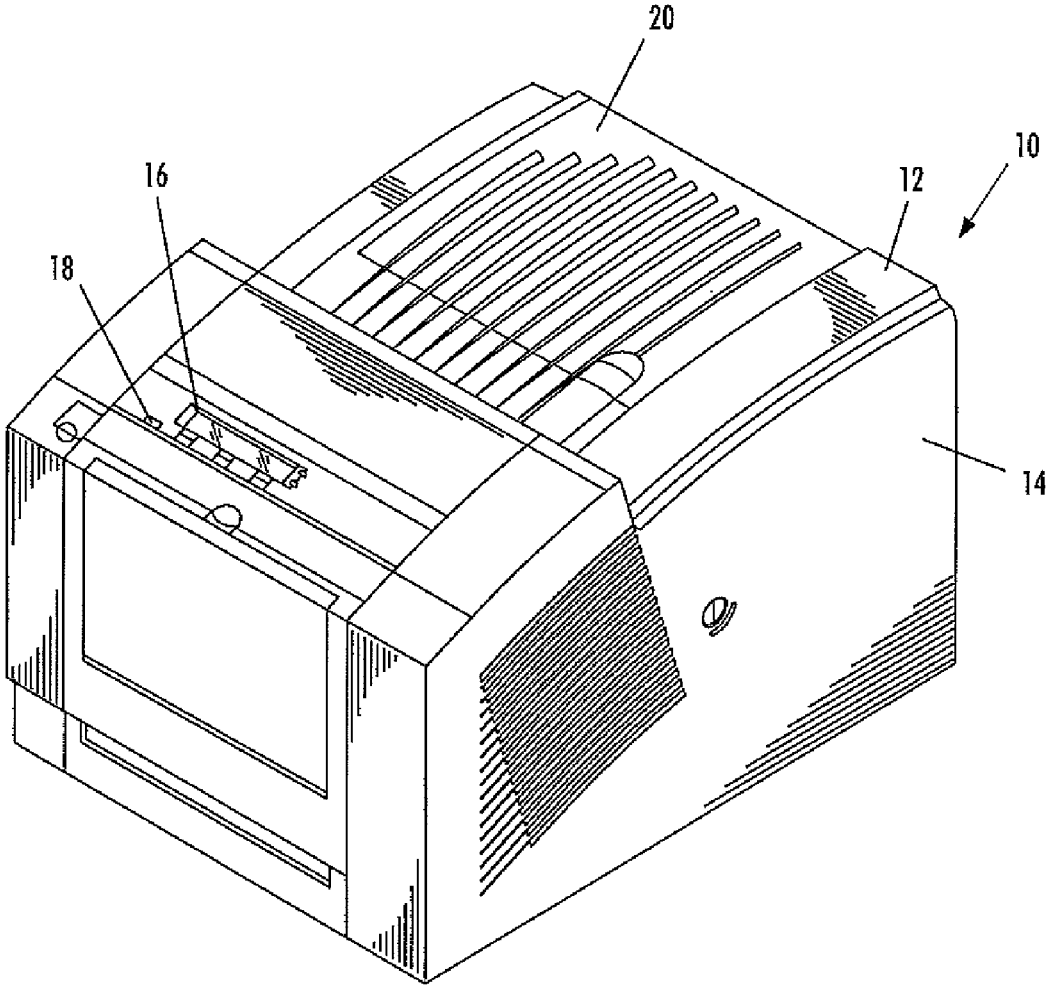
FIG. 1 is a perspective view of an ink printer with the printer top cover closed.

Referring to FIG. 1, there is shown a perspective view of an ink printer 10 that uses an intermediate imaging member to generate images on media sheets. The reader should understand that the embodiment discussed herein may be implemented in many alternate forms and variations. In addition, any suitable size, shape or type of elements or materials may be used.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens to provide the user access to the ink feed system.

Figure 2:
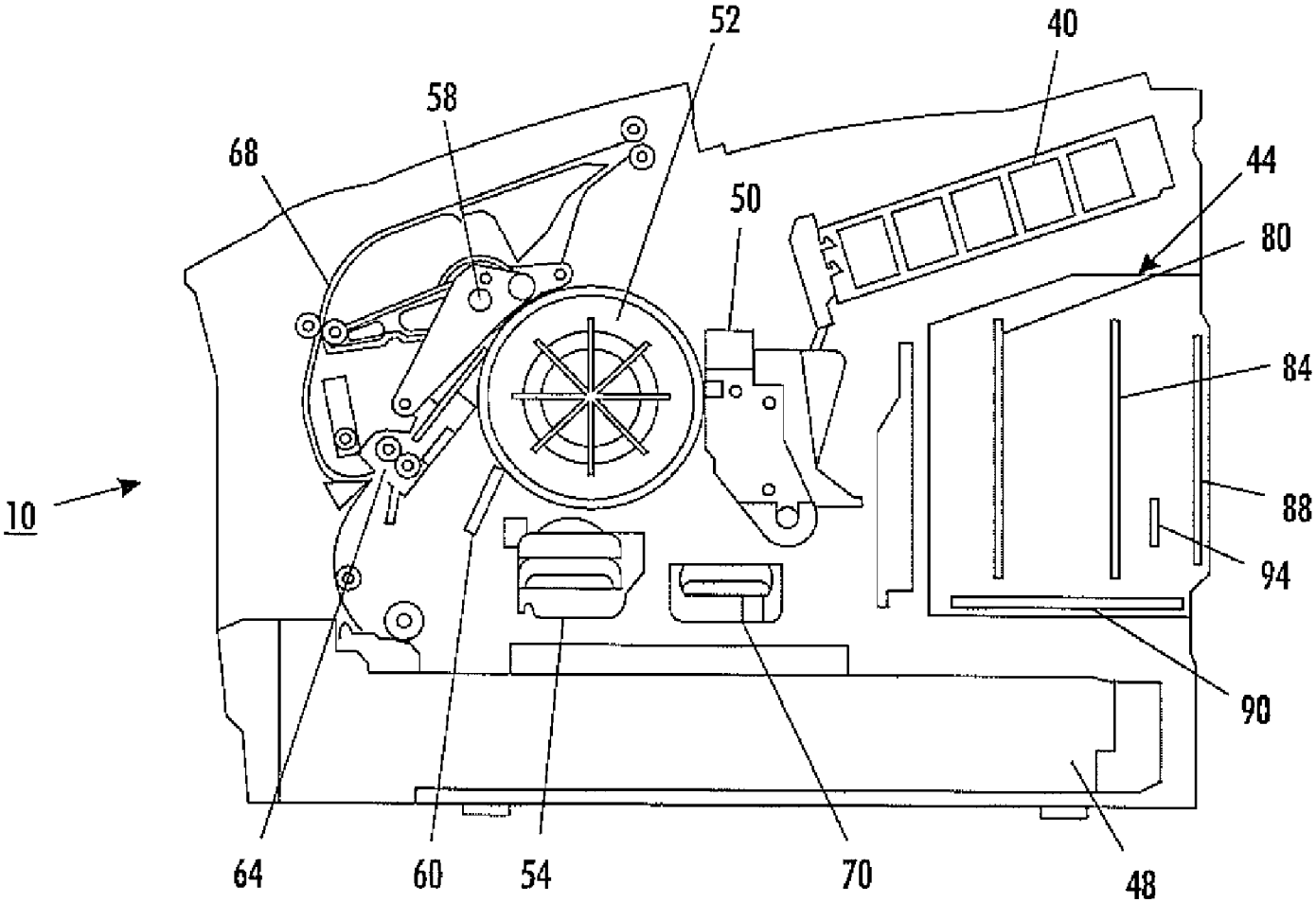
FIG. 2 is a side view of the ink printer shown in FIG. 1 depicting the major subsystems of the ink printer.

As shown in FIG. 2, the ink printer 10 may include an ink loading subsystem 40, an electronics module 44, a paper/media tray 48, a print head 50, an intermediate imaging member 52, a drum maintenance subsystem 54, a transfer subsystem 58, a wiper subassembly 60, a paper/media preheater 64, a duplex print path 68, and an ink waste tray 70. In brief, solid ink sticks are loaded into ink loader 40 through which they travel to a melt plate (not shown). At the melt plate, the ink stick is melted and the liquid ink is diverted to a reservoir in the print head 50. The ink is ejected by piezoelectric elements through apertures in chemically etched stainless plates to form an image on the intermediate imaging member 52 as the member rotates. An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the intermediate image member 52 is coordinated for the transfer of the image from the imaging member to the sheet of recording media.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the ink printer 10. The power control board 90 regulates these power levels. The configuration card contains data in nonvolatile memory that defines the various operating parameters and configurations for the components and subsystems of the ink printer 10. The hard drive stores data used for operating the ink printer and software modules that may be loaded and executed in the memory on the main card 84. The main board 84 includes the controller that operates the ink printer 10 in accordance with the operating program executing in the memory of the main board 84. The controller receives signals from the various components and subsystems of the ink printer 10 through interface components on the main board 84. The controller also generates control signals that are delivered to the components and subsystems through the interface components. These control signals, for example, drive the piezoelectric elements to expel ink through the apertures in the chemically etched print plates to form the image on the imaging member 52 as the member rotates past the print head.

Figure 3:
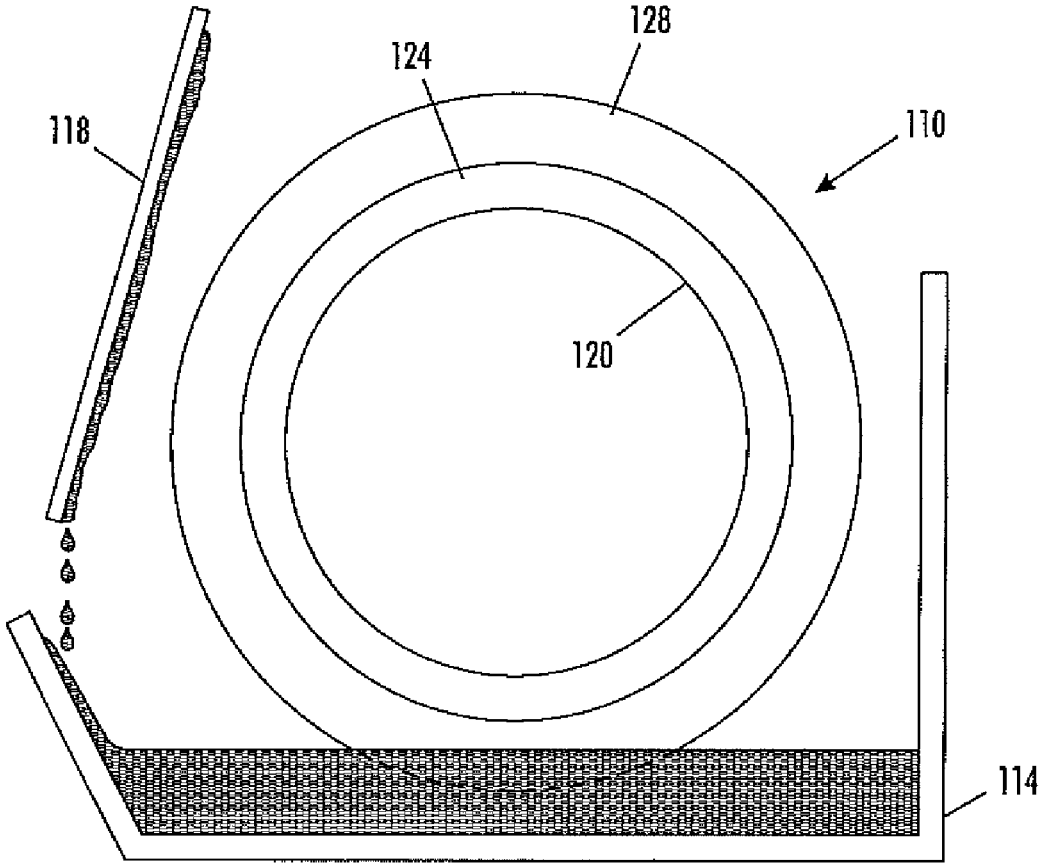
FIG. 3 is an end view of a release agent application system that applies and meters release agent to an intermediate imaging member in a solid ink jet imaging system.

In order to reduce the likelihood that ink ejected onto the imaging member 52 remains on the imaging member after transfer of an image from the drum to a media sheet, a film of release agent may be applied to the imaging member before ink is ejected onto the imaging member. A side view of the components that may be used to apply release agent to the imaging drum is depicted in FIG. 3. A release agent applicator 110 sits within a sump 114. The applicator may be positioned so it remains in contact with an imaging member 52 throughout its operational life or it may be coupled to an engagement mechanism for moving the applicator 110 into and out of engagement with an imaging member 52. A metering blade 118 may be positioned to meter release agent applied to the imaging member 52 by the applicator 110. The metering blade helps ensure that a uniform thickness of the release agent is present across the width of the imaging member 52. The blade may be fixed or it may be moved into and out of engagement with the imaging member 52. Excess release agent stopped by the blade 118 is diverted down the metering blade to the sump 114. Of course, a structure separate from the blade 118 may be used to catch the diverted release agent and direct it to the sump 114.

The structure of applicator 110, described in more detail below, enables release agent to be applied more copiously than applicators used with transfer or fuser rollers. The metering blade 118 regulates the release agent thickness on the imaging member 52 to the desired thickness without requiring the applicator to provide precise delivery of the release agent. If release agent applicators used on transfer or fuser rollers were used, most of the excess release agent diverted to the sump would remain in the sump as the outer layer of applicators for fusers do not have a pore size that facilitates absorption of low viscosity release agent. The outer layer of the applicator shown in FIG. 3, however, does have a pore size that facilitates absorption of the release agent diverted to the sump. Absorbing this diverted release agent enables the release agent to be applied to the imaging member 52 again, rather than being lost for subsequent use. If the diverted release agent was lost to the process, rather than recycled, then the operational life of the release agent application system would be relative short as the supply of release agent would soon be exhausted.

Figure 4:
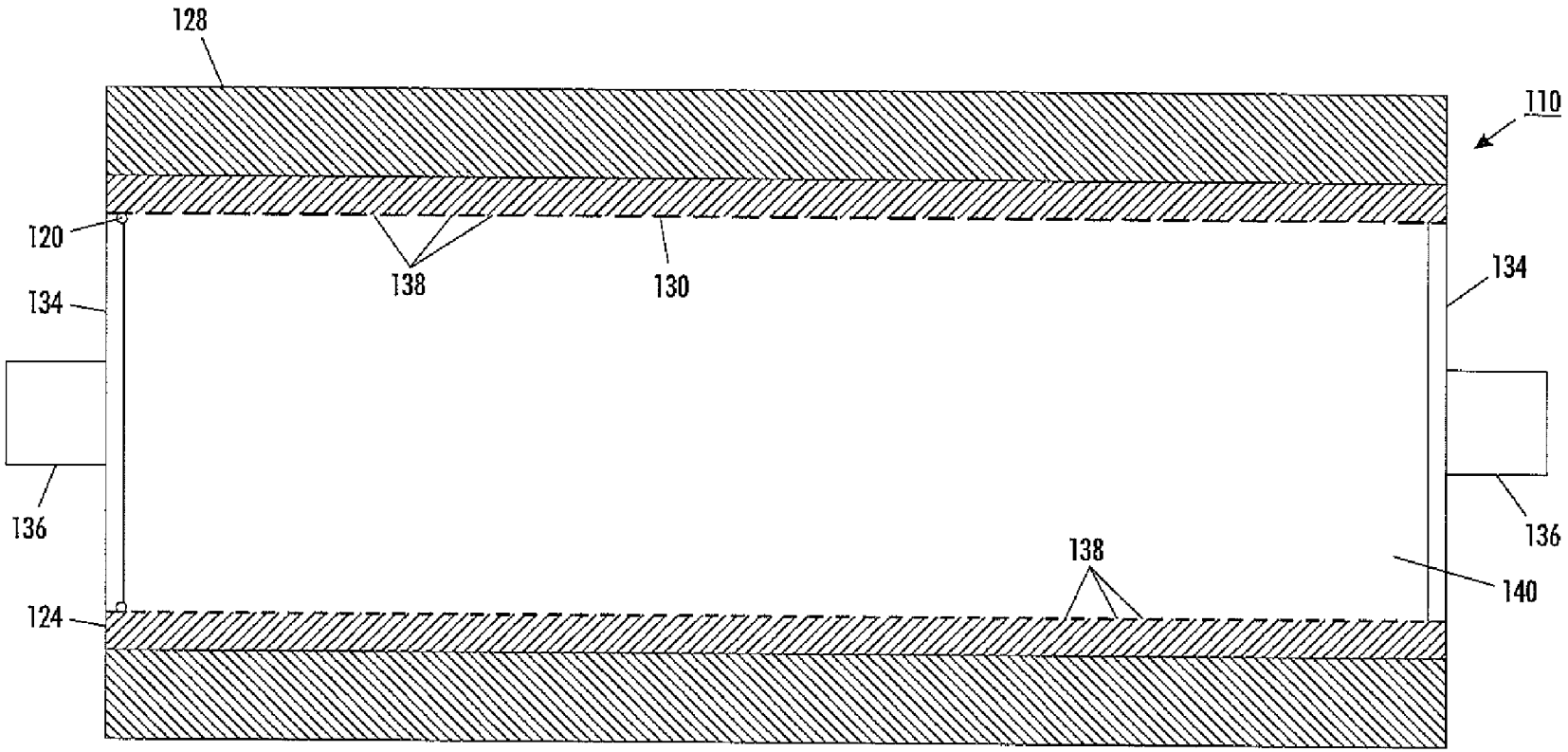
FIG. 4 is a longitudinal view of the release agent applicator shown in FIG. 3.

In one embodiment, the release agent applicator 110 has the structure shown in FIG. 3 and FIG. 4. A release agent applicator 110 is comprised of a tube 120 having a cylindrical wall 130 and two end caps 134. The cylindrical wall 130 is perforated with holes 138 to enable the release agent 140 to seep from the reservoir. A containment membrane 124 encases the cylindrical wall 130 to wick the release agent that seeps through the perforations 138 away from the cylindrical wall 130. Equilibrium in the containment membrane causes the release agent to flow through the membrane 124 to the delivery layer 128. The material used for the delivery layer 128 is matched to the material used for the containment layer 124 so that the release agent supply rate from the containment membrane maintains delivery layer saturation in a range of about 10% to about 90% of its release agent capacity. This capacity enables the delivery layer 128 to have sufficient release agent for copiously applying release agent to an imaging member, yet maintain reserve capacity for picking up release agent returned to the sump.

In further detail, the cylindrical wall 130 is manufactured from an oil phobic material, such as thermoplastic, sintered metal, ceramic, or the like. A plurality of perforations is formed in the cylindrical wall as part of its manufacture. In one embodiment, the perforations are approximately 12 μm in diameter, although other pore sizes may be used for various release agents and desired supply rates. End caps 134 may be made from the same or a compatible material. In the embodiment shown in FIG. 4, the end caps 134 have shafts 136 that may be placed in journal bearings so that the tube 130 may rotate to apply release agent from the delivery layer 128 to an imaging member 52. The end caps 134 may be mated within the ends of the cylindrical wall 130 by spin welding, gluing, or the like. One or both end caps 134 may be provided with a fill and/or vent port (not shown) to facilitate the filling of the release agent reservoir with release agent. Alternatively, one end cap could be installed to seal the tube 120 at one end and then the tube filled with release agent before the other end cap is installed. Incorporation of a fill and vent port in an end cap, however, facilitates refilling of the reservoir, if necessary.

The structure of the release agent applicator shown in FIG. 3 and FIG. 4 enables the use of thinner release agents, which are beneficial for transfer of ink to media. For example, the tube 120 may be filled with silicone oil having a viscosity of 10 cSt. Previously known release agent applicators use silicone oil having a viscosity of 50 cSt as "low" viscosity release agent. If oil having a viscosity of 10 cSt were used in such previously known systems, the oil supply would be quickly exhausted and the roller structure would poorly regulate the metering of the oil. Consequently, the structure of the applicator disclosed herein extends the range of oil viscosity that may be applied to an imaging member.

The containment membrane 124 is made from a porous oil phobic material having a relatively small pore size. The small pore size regulates the supply rate of release agent wicked from the perforations at a consistent, sustainable rate. For example, in one embodiment, the pore size of the material used for the containment membrane is about 0.5 μm to about 20 μm. Such porous oil phobic materials include polytetrafluoroethylene (PTFE), extended PTFE, GORE-TEX, and the like. The containment membrane 124 may be comprised of one or more layers of such material. In one embodiment of the release agent applicator, the containment membrane 124 is glued to the perforated wall of the release agent reservoir.

The delivery layer 128 is made from a material having a relatively large pore size. The size of the pores in the delivery layer is larger than the size of the perforations in the release agent reservoir. The larger pore size provides an adequate supply of release agent for immediate application to an imaging member and enables the delivery layer to pick up release agent that has been diverted into the sump. The matching of the delivery layer to the containment membrane as described above helps ensure that the uptake rate of the delivery layer 128 is greater than the release agent supply rate through the containment membrane 124. Materials that may be used for the delivery layer 128 are well known and are sometimes called foam material. Such materials include oil compatible foams of polyvinyl chloride (PVC), ethylene vinyl acetate (EVA), cross-linked polyethylene, nitrile butadiene rubber (NBR), or the like. In one embodiment of the release agent applicator, the pore sizes in the delivery layer are in the range of about 50 μm to about 100 μm.

In one embodiment of the release agent applicator, a release agent reservoir is a tube of approximately 22 cm in length and approximately 44 mm in diameter. The length of the tube is selected to correspond with the length of the imaging member that is lubricated by the applicator with the release agent. The cylindrical wall has a thickness that provides a release agent reservoir of approximately 200 ccm of 10 cSt silicone oil. The wall of the tube is formed with perforations of approximately 5 mm in diameter arranged in regularly spaced rows. The rows are approximately 30 mm apart and the perforations are approximately 1 cm apart. A film of extended PTFE is glued about the cylindrical wall of the tube. The film is approximately 25 μm in thickness. An delivery layer of PVC foam having a thickness of 4 mm is installed over the PTFE.

Although a particular embodiment has been described as a cylindrical roller, other geometrical shapes may be used. For example, the release agent reservoir may be a wicking pad in the shape of a rectilinear volumetric container having perforations formed in the wall(s) facing the imaging member. A containment membrane is positioned over the perforated wall (s) to regulate the transport of the release agent to the delivery layer. The delivery layer is positioned next to the containment membrane and matched to the containment membrane so the release agent supplied to the delivery layer saturates the layer to a level within a range of about 10% to about 90% of the delivery layer's capacity. The release agent diverted by the metering blade may be diverted onto the delivery layer or the application may extend into a sump for pick up of the diverted release agent. This extension need not overlay the containment membrane as this portion of the delivery layer enables the release agent in the sump to migrate to the delivery layer portion that applies release agent to the imaging member.

Figure 5A:
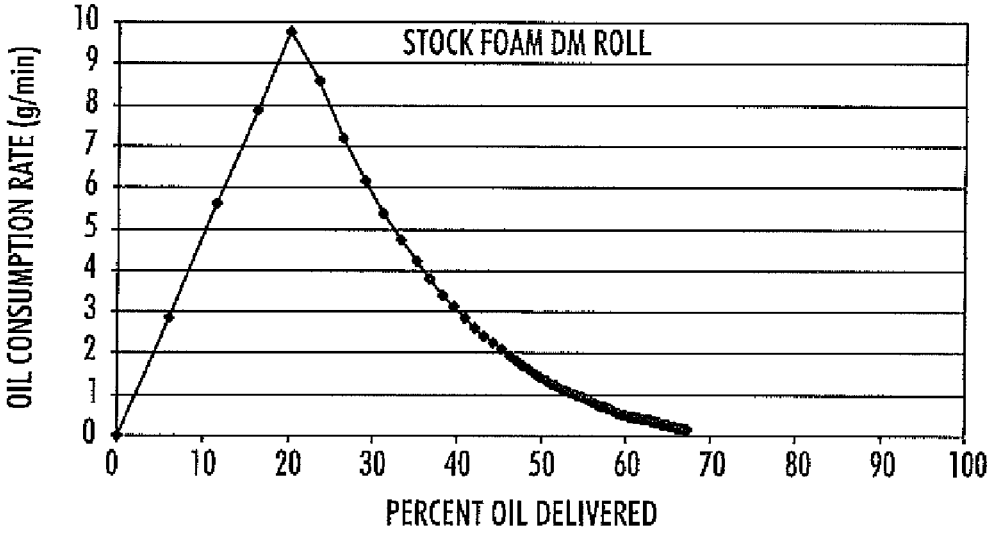
FIG. 5A is a graph of the release agent supply depletion for an applicator having a delivery layer only and FIG. 5B is a graph of the release agent supply depletion for a release agent applicator having the structure shown in FIG. 4.
Figure 5B:
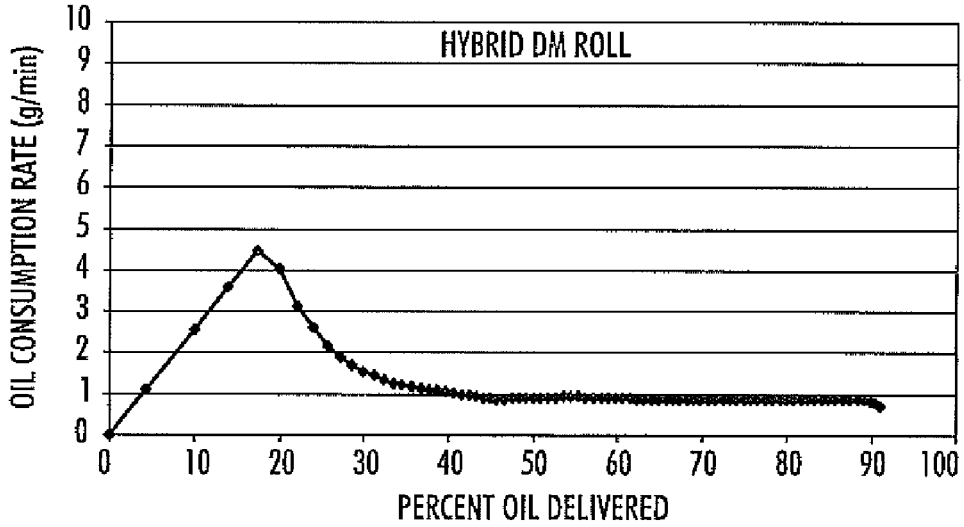

The graph of FIG. 5A depicts the depletion of the release agent supply of 10 cSt oil from a perforated reservoir over time. At the beginning of the operational life of the applicator, the supply drops precipitously in a very short period of time before the depletion rate flattens to exhaustion of the supply. The graph in FIG. 5B shows the depletion of the release agent supply of 10 cSt oil from an applicator having the structure shown in FIG. 4. This applicator was used in a solid ink printer that prints documents in both rotational directions of the imaging member. After a quick drop in which the delivery layer reaches a saturation level in the desired range, the supply remains relatively stable as diverted oil is returned to the delivery layer. After a relatively long period of stable delivery of release agent to an imaging member, the supply is more slowly depleted to exhaustion. Therefore, the structure of the applicator shown in FIG. 4 is able to extend the life of the release agent supply by stabilizing demand for release agent from the release agent reservoir. Additionally, the structure enables over 90% of the release agent with which the reservoir is initially filled to be used compared to about 60% utilization of the initial release agent volume in previously known applicators for intermediate imaging members.

Figure 6:
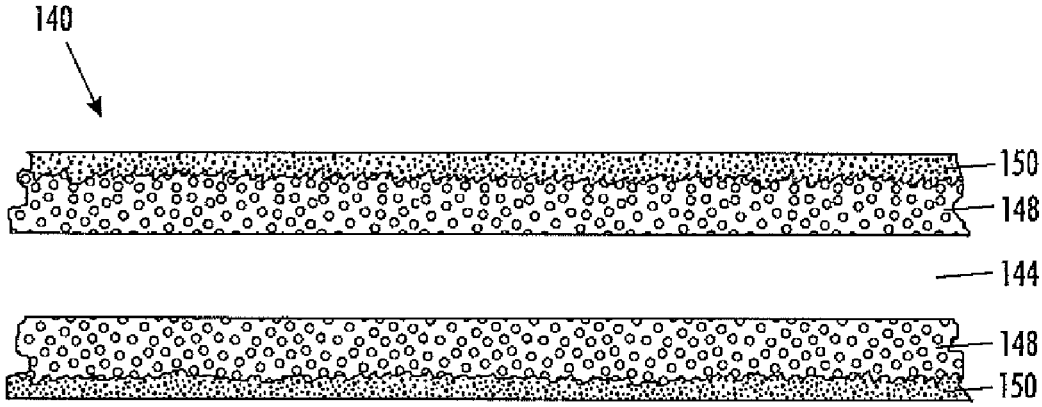
FIG. 6 depicts a longitudinal view of a co-extruded containment membrane and delivery layer for the applicator shown in FIG. 4.

A method for making an applicator having the structure shown in FIG. 4 may begin with a relatively thin walled tube. End collars, at least one of which has a fill and a vent port, are installed in the open ends of the tube by spin welding or the use of adhesives. The resulting release agent reservoir may then be pressure tested for leaks. The containment membrane and the delivery layer may be mounted about the tube as described above. Alternatively, the containment membrane and delivery layer may be co-extruded as a reservoir sleeve 140 that is shown in FIG. 6. In FIG. 6, an internal extruder die has produced an inner containment membrane 148 having a cylindrical void 144 centrally located in the membrane. This material has pores in a range of about 0.5 μm to about 20 μm. An external extrude die has produced an delivery layer 150 having pores in a range of about 50 μm to about 200 μm. The thickness of the containment membrane and the application may be controlled by the speed at which the two layers are produced. The two layers are co-extruded in a known manner that enables the two layers to come together without forming a skin. After the co-extruded sleeve 140 is cured and cut to appropriate length, the internal skin surrounding the void 144 is removed with a sanding process. This enables the containment membrane to wick the release agent seeping from the perforations of the release agent reservoir into the containment membrane. The skin on the outer surface of the delivery layer is ground to reach the appropriate outside diameter for the sleeve 140. This sleeve may be slipped over the perforated tube to form the applicator. The applicator may then be oriented vertically for filling the reservoir with release agent. Afterwards, the fill and the vent ports may be sealed. Additional release agent may be added to the delivery layer to establish a saturation level within the desired saturation range.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A release agent applicator comprising:

a reservoir for storing release agent, the reservoir having a plurality of perforations for enabling release agent to seep from the reservoir;

a containment membrane for wicking release agent from the perforations of the reservoir; and a delivery layer for delivering release agent from the containment membrane to an imaging drum, the delivery layer having pores in a range of 50 μm to about 200 μm.

2. The release agent applicator of claim 1 wherein the delivery layer has an uptake rate for release agent contacting an external boundary of the delivery layer that is greater than a release agent supply rate from the containment membrane to the delivery layer.

3. The release agent applicator of claim 1 wherein the delivery layer is matched to the containment membrane to maintain a saturation rate for the delivery layer in a predetermined range about 10% to about 90% saturation of the delivery layer.

4. The release agent applicator of claim 1, the reservoir comprising:

a tube having the perforations arranged in a cylindrical wall of the tube.

5. The release agent applicator of claim 4, the cylindrical wall of the tube being formed from oil phobic material.

6. The release agent applicator of claim 5, the oil phobic material being one of thermoplastic, sintered metal roll, and ceramic.

7. The release agent applicator of claim 4, the containment membrane is a material having pores in range of 0.5 μm to 20 μm.

8. The release agent applicator of claim 7 wherein the containment membrane is wrapped about the tube to form multiple layers for the containment membrane.

9. The release agent applicator of claim 7 wherein the material for the containment membrane is a porous oil phobic material.

10. A release agent applicator comprising:

a tube for storing release agent, the tube having a plurality of perforations arranged in a cylindrical wall of the tube that enable release agent to seep from the tube;

a containment membrane for wicking release agent from the perforations of the tube; and a delivery layer for delivering release agent from the containment membrane to an imaging drum, the delivery layer having pores in a range of 50 μm to 200 μm.

11. The release agent applicator of claim 10 wherein the delivery layer has an uptake rate for release agent contacting an external boundary of the delivery layer that is greater than a release agent supply rate from the containment membrane to the delivery layer.

12. The release agent applicator of claim 10 wherein the delivery layer is matched to the containment membrane to maintain a saturation rate for the delivery layer in a predetermined range about 10% to about 90% saturation of the delivery layer.

13. The release agent applicator of claim 10, the cylindrical wall of the tube being formed from oil phobic material.

14. The release agent applicator of claim 13, the oil phobic material being one of thermoplastic, sintered metal roll, and ceramic.

15. The release agent applicator of claim 13, the containment membrane is a material having pores in range of 0.5 μm to 20 μm.

16. The release agent applicator of claim 15 wherein the containment membrane is wrapped about the tube to form multiple layers for the containment membrane.

17. The release agent applicator of claim 15 wherein the material for the containment membrane is a porous oil phobic material.

* * * * *